United States Patent [19]

diDonato

[11] Patent Number: 4,480,400

[45] Date of Patent: Nov. 6, 1984

[54] BOUNCING TOY

[76] Inventor: Jose E. diDonato, 3545 Island Rd., Wantagh, New York, 11793

[21] Appl. No.: 503,785

[22] Filed: Jun. 13, 1983

[51] Int. Cl.[3] ..... A63H 3/31; A63H 1/06

[52] U.S. Cl. ..... 446/188; 446/198; 446/241

[58] Field of Search ..... 46/64, 85, 82, 75, 74 R, 46/1 R, 129, 145, 59

[56] References Cited

U.S. PATENT DOCUMENTS

| | | | |
|---|---|---|---|
| 847,755 | 3/1907 | Flora | 46/129 |
| 1,152,639 | 9/1915 | Isaacs | 46/129 |
| 1,213,943 | 1/1917 | Pecinovsky | 46/82 |
| 2,116,183 | 5/1938 | Beach et al. | 46/180 |
| 2,645,055 | 7/1953 | Ruczynski | 46/85 |
| 2,760,303 | 8/1956 | DelMas | 46/129 X |
| 2,799,120 | 7/1957 | Pitton | 46/85 |
| 2,937,473 | 5/1960 | Vlachos | 46/75 |
| 3,032,921 | 5/1962 | Greene | 46/145 X |
| 3,106,397 | 10/1963 | Lacey | 46/1 R X |
| 3,190,035 | 6/1965 | Armstrong | 46/129 X |
| 3,218,071 | 11/1965 | Richard | 46/129 X |
| 3,526,991 | 9/1970 | Goldfarb et al. | 46/129 |
| 3,589,059 | 6/1971 | Caswell | 46/82 |
| 4,233,774 | 11/1980 | Sahar | 46/82 |

FOREIGN PATENT DOCUMENTS

| | | | |
|---|---|---|---|
| 1154633 | 11/1957 | France | 46/129 |

*Primary Examiner*—F. Barry Shay

*Attorney, Agent, or Firm*—William V. Pesce

[57] ABSTRACT

A bouncing toy having a base supported by four springs-attached balls to give the base a bounce while maintaining stability. Central to the base is another spring attached ball having a cylindrical upright member mounted thereon. Within the cylindrical member are a series of radially extending pegs arrayed spirally to form a helix. Mounted to the base and surrounding the cylindral member is a hollow shaft including a rotatable wheel mounted thereon, the wheel having a helix-structured shaft connected thereto which is disposed to engage the radially extending pegs. Movements of the central ball causes the pegs and shaft to engage resulting in rotation of the shaft and attached wheel. The up and down movement of the toy causes the wheel to rotate in opposite directions until the toy comes to a complete stop. Audio devices are arrayed in proximity to each of the supporting balls so that the movements of the balls creates an environment which actuates the audio devices rendering various tones as the toy bounces.

5 Claims, 5 Drawing Figures

40
42
46
27
44
32
34
36
21b
28
26
30
24
21
10
22
12
17
19a
14a
20
14
16
18
5

BOUNCING TOY

BACKGROUND OF THE INVENTION

Self-propelled toys are usually powered by some energy source which must be replaceable from time-to-time to maintain the usefullness of the toy during its life time. When the energy source runs out the toy is non-functional. The toy contemplated herein is a toy which contains features allowing it to bounce in a controlled fashion and the effect of the bounce is to activate a heli-copter like propelling device which causes the bounce to continue in a controlled fashion. The toy is completely stablized until natural forces of friction causes the toy to come to a complete stop. To resume the action of the toy, the toy is merely lifted and allowed to free fall under gravitational forces to resume the bouncing action. The toy can be made to simulate some type of animal or human and can be considered educational in nature as well as useful as a toy.

Accordingly it is an object of the invention to provide a bouncing toy activated and maintained in a controlled fashion.

Another object of the invention is to provide a toy simulating an animal or human as it undergoes its movements according to the environment.

A still further object is to provide a toy which is actively self-sustaining and is devoid of energy providing sources to keep the toy going for a sustainable period of time.

In accordance with the invention, these and other objects are achieved by the present apparatus comprising a base with supporting ball-like elastic stabilizing elements attached thereto. The base supports a centrally positioned collapsible and distensible spring-held ball-like elastic element to which is mounted a cylinder having internally helix thread-like protruding elements for activating internally a supportable rotatable worm-like threaded shaft. The shaft is disposed to rotate in response to the vertical movements of the cylinder in accordance with the movements of the centrally positioned elasticball element. The rotatable worm-like element has connected thereto, at its upper extremity, a simple rotating spoked wheel lie element or propellar having peripheral elements or airfoils to create an aerodynamic effect giving lift-like and stabilizing qualities to the toy during the bouncing action and/or period. The wheel is made of durable light-weight material providing practically no inertia during the movements of the wheel regardless of its rotational direction. The toy can be made to simulate and look like any human or animal and made to perform as such. It is educational in nature and provides the user with something that is useful, educational and enjoyable. It is especially adaptable to or for young people. but can be enjoyed by others.

SUMMARY OF THE INVENTION

In accordance with the invention, these and other objects are achieved by the provisions of apparatus comprising a base supported by four bellows-like collapsible and distensible spring held balls disposed to permit the base to undergo a bouncing effect. Each of the balls contains in proximity thereto air-horns having varying tones each effected by the compression of air within the bellows-like collapsible and distensible spring during the bouncing process. Central to thr base, a larger control ball is attached to the base by a bellows-like spring and bounceable as the other four balls. The control ball at its upper surface supports a cylinder-like container or enclosure at its lower extremity. The cylinder has internally a helically arrayed, partially extended protrusions or peg-like members from top to bottom of the said cylinder. The cylinder thereafter terminated at its upper extremity into an orifice or aperture. The base further supports a guide cylinder or enclosure concentric with and surrounding the container at its lower extremity in an orifice or aperture. A helix-like ribbon vertical shaft member is centrally positioned within the said concentrix container and cylinder and is supported by the guide cylinder at the upper extremity thereof. The lower portion of the helical shaft resides within and is in contact with the helix portion and/or protrusions of the guide cylinder and is made to rotate in accordance with relative movements of the guide cylinder and helical shaft. The said helical shaft is provided with an extended rectangular rod disposed to engage a propellarmechanism and is driven thereby as the helical shaft rotates in accordance with the bouncing movement of the toy mechanism. The deflection of the bouncing control ball causes the reciprocal movement of the helical shaft and the rotation of the wheel or propellar mechanism. There is practically no inertia to the wheel so that motion of the propellar appears to be continuous. Further the bouncing mechanism produces varying tones by the air-horns to give a pleasing effect. The device may be enclosed by any toy animal or creature which is pleasing to the user.

DETAILED DESCRIPTION OF SPECFIC EMBODIMENTS

These and other objects and features of the invention will be more readily understood from the example now to be described in detail, although it will be understood that the invention is in no way limited to the specific embodiment and which is shown only in the interest of complete definiteness.

Figure 1:
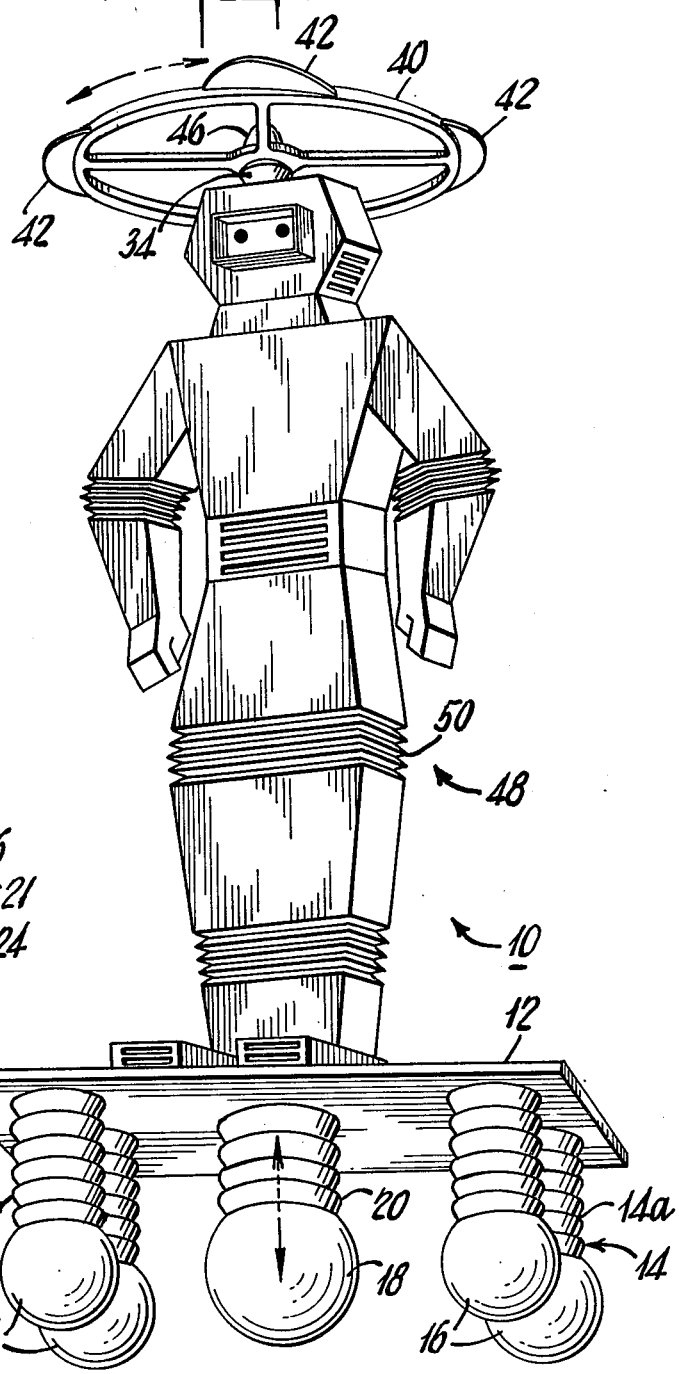
FIG. 1 shows in perspective the bouncing toy according to the invention.
Figure 5:
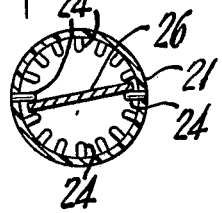
FIG. 5 is a cross section through the line 5—5 of FIG. 2.
Figures 2, 3, 4:
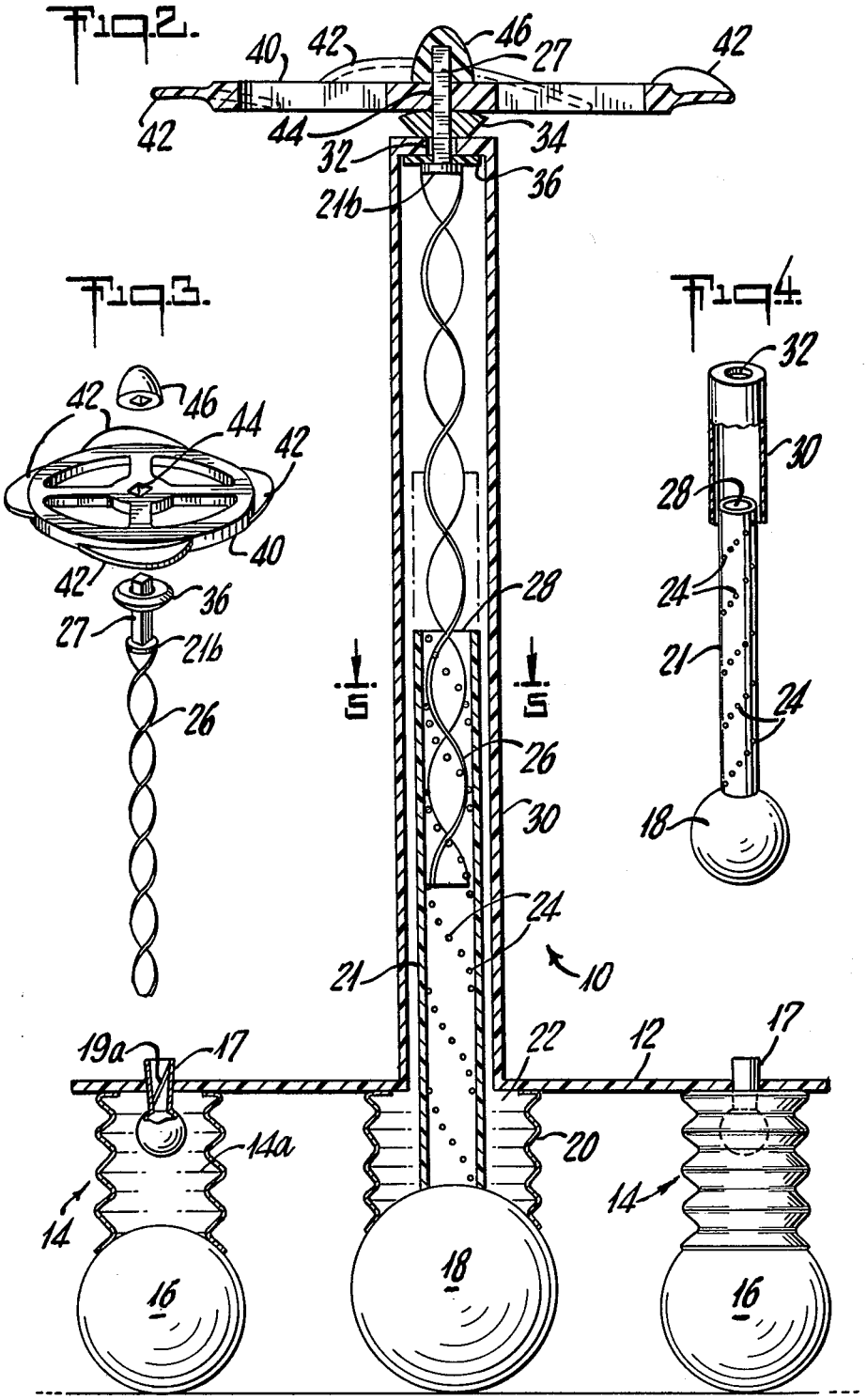
FIG. 2 shows in section an elevational view of the bouncing toy completely assembled and operable with the toy figure mounted thereon.
FIG. 3 shows a partial view in perspective of the propellar wheel, driving helix shaft and and capping device for assembly.
FIG. 4 shows a partial elevational view of the guide and control cylinders axially aligned with the control ball secured to the control cylinder.

Referring now to FIG. 1 there is shown an aerodynamic bouncing toy 10 comprising a base or platform 12 supported by four bellows-like spring members 14 each welded to or attached to high bounce balls 16, each of said balls being suspended or held by the said spring 14 independantly of each other so that the platform can be easily tilted in different directions. In proximity to each of said bellows-like springs 14, each being covered by mesh material **14*a*, and mounted to the platform 12 is an air horn 17 each disposed to be activated by air action within the bellows 14, and each having distinctive tones to create a music-like effect. The horns each have a distinctive tone reed 19***a* activated by air so that different tonal frequencies are generated.

Central to the support platform 12 is located a control hi-bounce ball 18 and held to the platform by a bellows-enmeshed spring member 20 comparable to the springs 14. The hi-bounce ball 18 has connected thereto a control cylinder 21 which protrudes upward through a hole 22 in the support platform 12. The control cylinder 21 has disposed therein a helically arrayed protruding radially inward a series of peg-like members 24 for receiving and activating a ribbon-like worm-screw propellar shaft 26 which extends through an opening 28 at the top of the control cylinder 21.

The propellar shaft 26 is helically conformed, terminating at its upper extremity in guide 21*b* and lower extremities in guide discs 21*a*, 21*b* to maintain the propellar shaft central to the control cylinder 21. The uppermost part of the propellar shaft 26 terminates in an elongated rod-like rectangularly shaped member 27. Concentric to the control cylinder 21 and surrounding it is a hollow guide cylinder 30 attached to the support surface or base 12 and movable therewith. The guide cylinder 30 terminates at its upper extremity into an aperture or hole 32 which permits the extended rod 27 Of shaft 26 to pass there-through and through friction free beveled washers 34,36 sandwiching the aperature or hole 32 at the upper part of the said guide cylinder. The beveled washers are friction-free to permit freedom of movement of the helical shaft during its rotation while still maintaining the shaft 26 central to the guide cylinder 30.

Capping the propellar shaft extended rod 27 is a propellar like member in the shape of a spoked wheel 40 having segmented peripheral fins 42 shaped like air-foils to create aerodynamic turbulance to give helicopter like action and/or motions to the toy. The wheel hub aperture 44 is rectangular in shape and snugly fits around the extended rectangular shaft 27 which causes the wheel to rotate when the propellar shaft 26 rotates. The wheel 40 and propellar shaft 26 are held secure by a snap lock cap 46 so that the cap, wheel, and propellar shaft all ratate as one integrated unit while the assembly of all the parts are maintained secure during the functional operation of the bouncing toy.

OPERATION OF THE TOY

In operation the toy 10 is conveniently dropped from any suitable height to the floor or any flat surface so that upon impact with the floor the control or control hi-bounce ball will compress the bellows-like spring member 20 and in so doing drives the control cylinder 21 in an upward direction. The upward movement of the control cylinder 21 causes the worm-screw propellar shaft 26 to rotate by virtue of the frictional contact with the helix arrayed peg-like member 24 in a first direction. The rotational movement of the propellar shaft drives the propellar wheel 40 accordingly and with it the fins 42 to provide some form of lift to the toy. When the control ball 18 is off the floor because of the bouncing ball effect, the spring 20 causes the control cylinder 21 and ball to reverse direction and the propellar shaft follows the action by rotating in the reverse direction. Hence there is constant upward and downward motion of the toy during the bouncing process. The toy is fundamentally stabilized by the supporting balls which are disposed to give maximum stability by their symetrical arrangement and thus avoid the possibility of the toy from overturning and thereby render the toy completely immobile. As the toy bounces, the horns 17 in proximity to the support balls 20, are each actuated by the air generated by the bellows to produce sounds give the desired tonal or sound effect.

It may be appreciated that although the spring members 14 and 20 have been indicated as bellows-like in form ordinary coil springs can be used. The balls 16 may actuate the horns by coming in contact therewith. The balls supporting the platform as well as the central ball can be of any suitable material whose composition provides high resiliency and bounce to the ball on contact with the impact surface.

The completed and assembled toy is actually shown as FIG. 1 in the image of a space man 48 having finned extensions 50 to provide a certain mobility to the spaceman as the toy bounces, thereby giving the space-man a degree of authenticity. It can be appreciated that other speciman-like figures can be used to give the effect desired by the user in the operation of the toy. The toy is also vented to permit air therein to avoid condensation.

While the invention has been described with particular reference to a specific embodiment, in the interest of complete definiteness, it will be understood that it may be embodied in a variety of forms diverse from those specifically shown and described without departing from the spirit and scope of the invention as defined by the appended claims.

Having described the invention what is claimed is:

1. A bouncing toy comprising;

(a) a base including stabilizing collapsible and distensible support means comprising spring members attached to the base to provide bounce and stability thereto, (b) collapsible and distensible control means comprising a spring member attached to said base in proximity to the base support means having a first enclosure mounted thereon which includes therein helically oriented protruding means forming a part thereof, (c) second enclosure means surrounding and in communication with said first enclosure and attached to said base and forming an integral part thereof, (d) rotatable means including a helical shaft member carried by said second enclosure, the said shaft being disposed to impact said helically protruding means in said first enclosure to impart rotational movements to said rotatable means, and (e) audio means in proximity to said base support means and coacting therewith for providing an audio indication of the bouncing movements of the toy.

2. A bouncing toy according to claim 14 and wherein said protruding means includes helically arrayed members radially protruding along the inner wall of said first enclosure.

3. A bouncing toy according to claim 1 and wherein said rotatable helical shaft member is a ribbon-shaped, worm-screwconfigured member.

4. A bouncing toy according to claim 1 and wherein said rotatable means includes a circular wheel with peripheral fins attached thereto for increased stability.

5. A bouncing toy according to claim 1 and wherein said audio means includes air-activated horns having reed members of varying pitch to produce different sounds.

* * * * *